US007637133B2

(12) United States Patent
Buta

(10) Patent No.: US 7,637,133 B2
(45) Date of Patent: Dec. 29, 2009

(54) CASSETTE ROLLER LEVELER WITH COMMON BACK-UP ROLLS

(75) Inventor: John R. Buta, Salem, OH (US)

(73) Assignee: Butech Bliss, Salem, OH (US)

( * ) Notice: Subject to any disclaimer, the term of this patent is extended or adjusted under 35 U.S.C. 154(b) by 230 days.

(21) Appl. No.: 11/827,457

(22) Filed: Jul. 12, 2007

(65) Prior Publication Data

US 2008/0011036 A1 Jan. 17, 2008

Related U.S. Application Data

(60) Provisional application No. 60/830,634, filed on Jul. 13, 2006.

(51) Int. Cl.
*B21D 1/02* (2006.01)

(52) U.S. Cl. ..... 72/164; 72/238; 72/241.2

(58) Field of Classification Search ..... 72/160, 72/163, 164, 165, 237, 238, 239, 241.2, 241.4
See application file for complete search history.

(56) References Cited

U.S. PATENT DOCUMENTS 3,269,163 A * 8/1966 Ripling et al. ..... 72/163
3,606,784 A * 9/1971 Schluter ..... 72/165
3,648,505 A * 3/1972 Eibe et al. ..... 72/165
4,313,322 A * 2/1982 Malinowski et al. ..... 72/164
4,633,697 A * 1/1987 Blough ..... 72/164
5,097,691 A * 3/1992 Slabowski et al. ..... 72/165
7,302,820 B2 * 12/2007 Le Viavant ..... 72/237

* cited by examiner

*Primary Examiner*—Edward Tolan
(74) *Attorney, Agent, or Firm*—Fay Sharpe LLP

(57) ABSTRACT

A roller leveler having a frame; a first bank of upper and lower work rolls journalled in the frame via a work roll journal housing; and a bank of back-up rolls in contact with the work rolls to support the work rolls. The work rolls perform leveling on a work product passing through a gap formed between upper and lower work rolls. The back-up rolls are mounted to the roller leveler frame via a back-up housing. The back-up rolls are movable to allow the first bank of work rolls to be removed and a second bank of work rolls to be installed wherein the second bank of work rolls includes work rolls of a different diameter than the first bank of work rolls.

19 Claims, 3 Drawing Sheets

CASSETTE ROLLER LEVELER WITH COMMON BACK-UP ROLLS

CLAIM OF PRIORITY

This application claims priority from Provisional Application Ser. No. 60/830,634, filed on Jul. 13, 2006, which is incorporated by reference herein.

BACKGROUND

The present embodiment relates to roller levelers. It finds particular application in conjunction with roller levelers with common back-up rolls, and will be described with particular reference thereto. However, it is to be appreciated that the present embodiment is also amenable to other like applications.

A roller leveler typically includes multiple pairs of offset work rollers or rolls. Different size levelers can have different quantities of work rolls and back-up rolls. The upper rolls are typically offset one-half the distance between a pair of adjacent lower rolls. The metal strip passes between the upper and lower rolls. The number and spacing of the rolls depend on the thickness and strength of the metal strip. Typically, as the strip thickness decreases, the spacing of the rolls, as well as the roll diameter, decrease. As the strip passes between the rolls, it is bent up and down multiple times before it exits the leveler. This reversed bending beyond the yield point of the material is the mechanism whereby the strip is flattened.

Metal is formed into strip by a process known as rolling, wherein the strip is passed between a pair of work rolls of a rolling mill to reduce its cross-sectional thickness. In the process, the strip is elongated and rolling continues until the strip is reduced to the cross-sectional thickness desired. This rolling process may start with heated billets or slabs of metal, wherein the metal is rolled at a very high temperature, or it may start with previously rolled strip wherein the strip is passed between work rolls in the cold state. In either event, when the strip exits from the mill, it may be convolutedly wrapped to form a coil. When the coil has been formed, curvature of the coil tends to stay with the strip when it is necessary to uncoil the strip for further processing. Thus, the primary problem with strip coming off of a coil is the curvature which remains with the strip and which varies throughout the entire length of the coil as a function of the radius of any particular portion of the strip while in the coil. Accordingly, the outer wrap of the coil will have less curvature than an inner wrap. To remove this variable curvature in the strip is one of the purposes of a roller leveler. It is necessary to remove this curvature so that the strip may be cut accurately and rendered suitable for other manufacturing operations, such as punching, drawing, forming and the like. It is well established that the flatter the strip is prior to a subsequent manufacturing operation, the more accurate and satisfactory will be the end product of that operation. Thus, even where portions of steel strip are deep drawn, they do not draw as satisfactorily if the strip initially is not substantially flat before the draw.

In addition to strip curvature, other unwanted properties are sometimes impressed upon the strip during hot and/or cold rolling which render the problem of flattening strip much more complex. In order to reduce cross-sectional thickness of the strip during rolling, it is necessary to force the strip between rolls under tremendous pressure whereby the strip essentially becomes a wedge which tends to separate the rolls. The force of roll separation is dependent upon the physical properties of the strip including width, thickness, hardness, temperature, yield strength, and amount of reduction being attempted during the pass of the strip between the rolls. If the work rolls are not sufficiently supported by back-up rolls, it is possible for the strip to actually cause the work rolls to bend at their centers, wherein the resultant strip cross-sectional shape is thicker in the middle than at the edges. Strip rolled with thicker center portions indicates that greater pressure has been applied to the edges of the strip than at the center, thereby causing the edges to elongate at a greater rate than the center of the strip. Because this excess metal on the edges must go somewhere, but is restrained by the center, the result usually is a product having what is referred to as edge waves. In other words, the center of the strip is relatively flat longitudinally, but the edges of the strip are sinusoidal.

Just the opposite may occur during rolling of strip, wherein the rolls may be so reinforced, or may be so contoured, that they resist or otherwise offset the wedge effect of the strip. However, if the rolls are over compensated against roll bending, the resultant is strip that is rolled thinner in the center than at the edges. In this circumstance, the center of the strip tends to become elongated, producing a condition sometimes referred to as "oil canning". By this is meant that the elongated center portion of the strip compensates for this elongation by bulging either up or down. The result is strip that can literally be snapped up and down like the bottom of an oil can because of the stresses set up by this localized elongation.

A metal strip product is fed into a roller leveler, typically from a coil. Roller levelers use multiple work rolls to flatten the strip as it passes through the leveler. The path of the strip passes between offset upper and lower work rolls, in effect reverse bending the strip multiple times before the strip exits the leveler.

A typical roller leveler is designed to process a range of strip thicknesses and strip yield strengths. As the strip passes between the work rolls, very high separating forces are generated against the work roll face, yet the work roll diameters are of necessity relatively small; this is to allow the work rolls to bend and to space them close enough to properly work the strip. The work rolls are supported by flights or groups of back-up rolls. The back-up rolls support the work rolls and prevent them from incurring excessive bending in reaction to the separating forces.

If a process line requires a wider range of strip thicknesses, two levelers can be used, or alternatively, one leveler can be supplied with multiple work roll diameters and spacings. These machines are typically called cartridge or cassette type levelers. In the cassette style machine, present practice requires that a cassette consist of the upper and lower work rolls, as well as the corresponding upper and lower back-up rolls. Thus, this combination of stacked rolls, including the back-up rolls, is removed and injected into the leveler as a unit, which increases costs, time and maintenance of the leveler unit.

Thus, there is a need for a roller leveler with common back-up rolls which does not require the removal of the back-up rolls from the leveler and overcomes the above-mentioned deficiencies while providing better and more advantageous overall results.

SUMMARY OF THE INVENTION

The present invention relates to roller levelers. More particularly, it relates to roller levelers with common back-up rolls.

In accordance with one aspect of the invention, a roller leveler has a frame; a first bank of upper and lower work rolls journalled in the frame via a work roll journal housing; and a bank of back-up rolls in contact with the work rolls to support the work rolls. The work rolls perform leveling on a work product passing through a gap formed between upper and lower work rolls. The back-up rolls are mounted to the roller leveler frame via a back-up housing. The back-up rolls are movable to allow the first bank of work rolls to be removed and a second bank of work rolls to be installed. The second bank of work rolls includes work rolls of a different diameter than the first bank of work rolls.

In accordance with another aspect of the invention, a method of installing various diameter work rolls in a roller leveler, includes removing a first work roll cassette including work rolls of a first diameter; unlocking the back-up roll housing from a leveler frame; lowering the back-up housing until the back-up housing clears the leveler frame; shifting the back-up roll housing horizontally to shift back-up rolls by approximately a half pitch; raising the back-up housing until the back-up housing abuts the leveler frame; locking the back-up housing to the leveler frame; and installing a second work roll cassette including work rolls into the leveler, wherein the second work roll cassette includes work rolls of a smaller diameter than the first work roll cassette.

In accordance with yet another aspect of the invention, a method of installing work rolls in a roller leveler includes removing a work roll cassette of work rolls of a first diameter; unlocking a back-up roll housing from a leveler frame; shifting the back-up housing horizontally to shift back-up rolls by approximately a half pitch; raising the back-up housing until the back-up housing contacts the leveler frame; locking the back-up roll housing to the leveler frame; and installing a work roll cassette of work rolls of second diameter, wherein the second diameter is larger than the first diameter.

One aspect of the present invention is to eliminate the need to remove the back-up rolls when there is a need to insert a work roll cassette that utilizes a different work roll diameter.

Another aspect of the present invention is the reduction of time to exchange the work rolls, which results in more productivity and throughput for the line.

Still another aspect of the invention is the reduction in overall costs, as only one set of back-up rolls is required.

Yet another aspect of the present invention is the ease of maintenance, as the work roll faces are immediately accessible for cleaning when the rolls are extracted from the leveler; that is, there is no need to remove back-up roll to access the work rolls.

Still yet another aspect of the invention is the provision of the back-up rolls being manipulated to accommodate the new work roll diameter and new work roll pitch, without changing the passline of the strip.

Other aspects and features of the invention will become apparent to those skilled in the art from a study of the detailed descriptions of the preferred embodiments set forth herein and illustrated in the accompanying drawings.

BRIEF DESCRIPTION OF THE DRAWINGS

Further aspects of the invention will become apparent by reference to the detailed description when considered in conjunction with the figures, wherein like reference numbers indicate like elements through the several views, and wherein.

DETAILED DESCRIPTION

One of the primary functions of a roller leveler is to remove curvature from a piece of metal strip, sheet or plate. Strip is defined to mean metal which is sufficiently narrow and is rolled sufficiently thin that it can be wrapped into a coil. A sheet is defined as metal that is, for whatever reason, cut into lengths rather than stored in coiled form. Plate is metal which is too thick, as a practical matter, to be formed into a coil.

Figure 1:
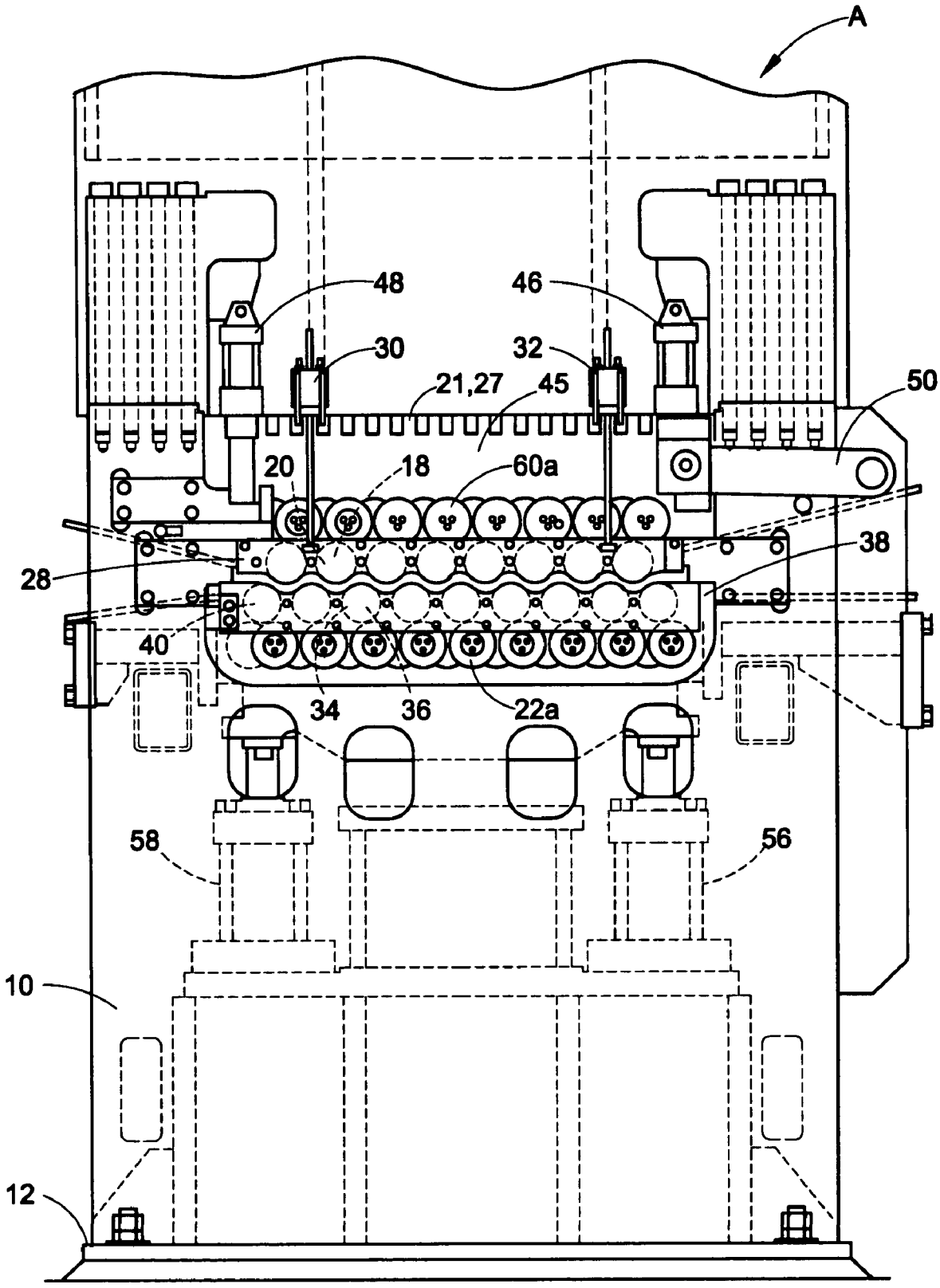
FIG. 1 is a side elevational view of a roller leveler assembly with large diameter work rolls and common back-up rolls in accordance with an embodiment of the present invention.

In the case of sheets and plates, the curvature would normally be of a substantially constant radius and the roller leveler means could be of the simplest form to flatten the sheet or plate. Referring to FIG. 1, for this operation, the roller leveler would theoretically require an upper work roller 20 and a pair of lower work rollers 36. It will be observed that a sheet moving from right to left is flexed downwardly between an upper work roller 20 and a lower work roller 36 to the right of roller 20 and then is reverse flexed between an upper work roller 20 and another lower work roller 36 to the left of roller 20 which removes the simple curvature from the sheet. To remove the curvature from the sheet the upper work roller and lower work rollers must be properly positioned with respect to each other. This positioning will vary depending upon the amount of curvature which must be removed from the sheet. Thus, the upper and lower work rollers are vertically adjustable with respect to each other to increase or decrease the gap between the rollers.

The other important use of roller levelers is to make corrections in the shape of strip as it comes from the rolling mill. When strip is passed between the rolls of a rolling mill, tremendous pressures are exerted against the rolls tending to force them apart. When this occurs, the strip tends to be rolled thinner at the edges than in the center portion. The difference between the thickness of the edges of the strip and of the center of the strip may be only a few thousandths of an inch or less. When this condition occurs, the edges of the strip are thinner, because more metal has been rolled in these areas than in the center portion, resulting in edges which are longer than the center portion of the strip. As a consequence, since the edges of the strip are restrained from elongating by the shorter thicker center portion of the strip, these edges respond to this restraint by forming into edge waves. Strip may also be rolled with the center portion thinner than the edge portions.

Figure 2:
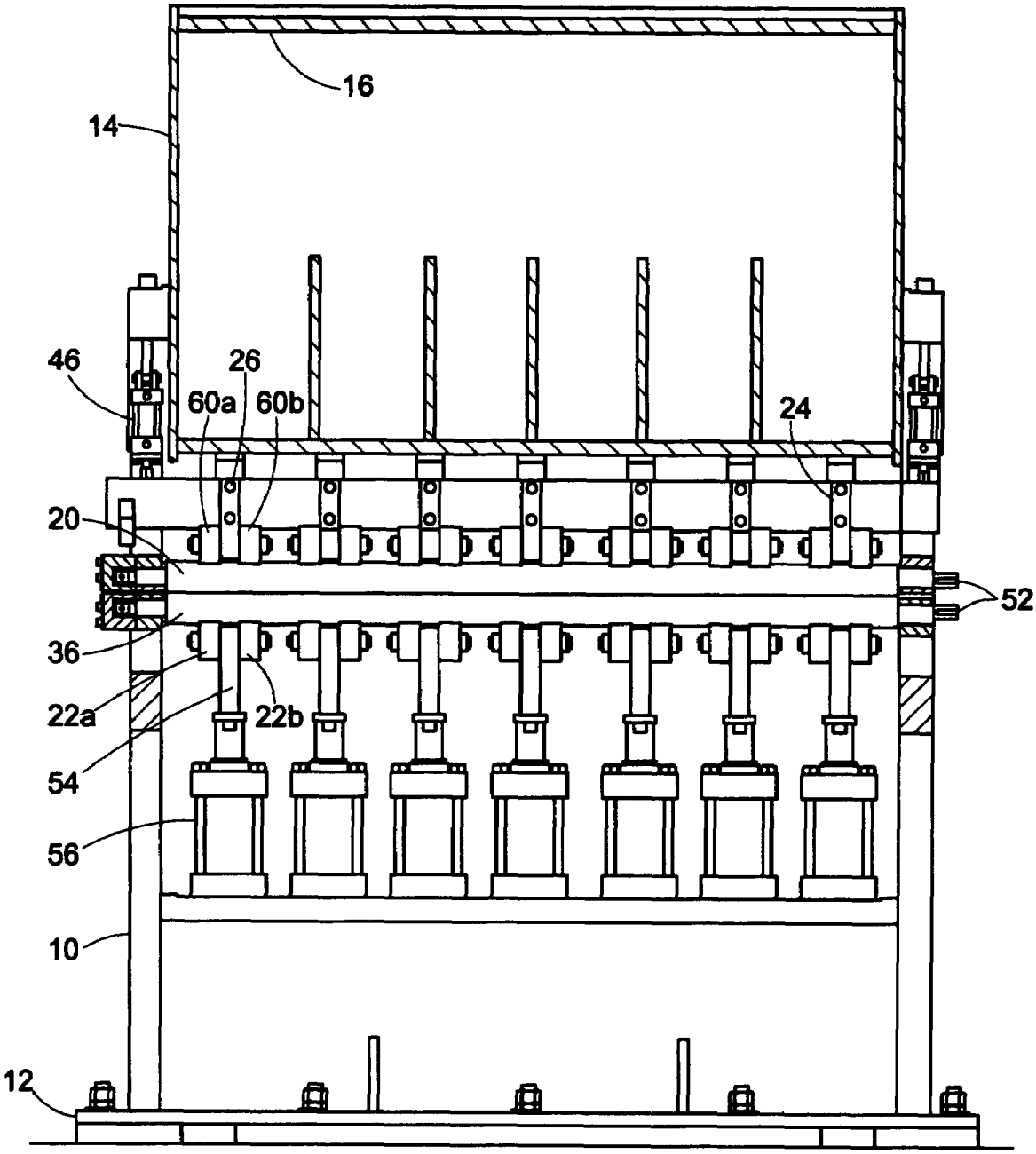
FIG. 2 is a front elevational view of the roller leveler of FIG. 1.

Referring now to the Figures in greater detail, and in particular to FIGS. 1 and 2, therein is shown a roller leveler A comprising a weldment frame having steel side slabs 10, welded to base slab 12 to form the lower half of the frame. As best shown in FIG. 2, the upper half of frame 10 comprises slabs 14 welded to slabs 16.

Referring to FIGS. 1 and 2, roller leveler assembly A has upper, large diameter work rolls 20 in their operating position and upper back-up rolls 60*a*, 60*b* in working position to ride and support the outer diameter of the work rolls.

Referring to FIG. 2, it can be seen that the back-up rolls 60*a*, 60*b* consist of a number (flight 24) of narrow face rolls that are mounted on back-up support beams 26 that transmit the work roll separating forces to the upper leveler housing.

Referring now to FIG. 1, an upper bank 18 of a plurality of separately driven work rollers 20 is supported at opposite ends of the rollers by journal beams 28. In one embodiment of the invention, the upper work roll journals are retained vertically by locks or clamps 30, 32 as shown in FIG. 1. In the across machine direction, the upper work roll journals are constrained by gibs to prevent side shifting of the work rolls in the across machine direction. In other embodiments, the upper work roll journal beams use cylinders for the vertical clamp. Gibs, however, are still used for the across machine retention. The upper work rolls do not shift vertically or arcuately during operation. The above described clamps are utilized for "quick" roll change of the work rolls.

A lower bank 34 of separately driven large diameter work rollers 36 is shown with opposite ends journalled in journal beams 38. Journal beams 38 are fitted in gibs to permit vertical and/or arcuate movement. It will be observed that work rollers 20 of upper bank 18 are spaced to nest between pairs of lower work rollers 36 in lower bank 34.

Lower back-up rolls 22*a*, 22*b* are in working position to ride and support the outer diameter of work rolls 36. FIG. 1 shows a group or cassette 40 of the large diameter work rolls 20, 36. In contrast, referring to FIG. 3, a cassette 42 of small diameter work rolls 44, 43 is shown. By comparing the large diameter work rolls 20, 36 of FIG. 1 to the small diameter work rolls 44, 43 of FIG. 3, it is easy to see that the spacing and elevations of the two work roll diameters varies substantially. The present invention repositions the upper back-up rolls 60*a*, 60*b* in a manner that compensates for both variations of work roll diameters, including a change in height and a change in pitch.

Referring back to FIG. 1, upper back-up housing 45 for back-up rolls 60*a*, 60*b* is shown to be engaged to the leveler upper frame via a set of nesting "teeth" 21, 27. The teeth 21 of the back-up housing 45 and the teeth 27 of the upper portion of frame 10 are shown engaged and nested within each other. This corresponds to the operating position for the larger work roll diameter. For purposes of illustration of this embodiment, the work roll larger diameter is essentially twice the work roll smaller diameter; however, other sizes of large and small work roll diameters could be used without departing from the scope of the invention. Correspondingly, in this embodiment, the pitch for the larger diameter is essentially twice the pitch for the smaller diameter; however, other variations of pitch can be used without departing from the scope of the invention.

For ease of reference, the installation of the smaller and larger diameter work roll cassettes will be described below with reference to movement of the upper back-up rolls 60*a*, 60*b*. These steps could also be performed by moving the lower back-up rolls 22*a*, 22*b* without departing from the scope of the invention. The steps would be adjusted to raise or lower the lower back-up rolls as necessary to remove and install the small and large diameter work roll cassettes.

To remove the larger diameter work roll cassette 40 from the leveler, the larger diameter work roll cassette 40 is removed or ejected from the leveler. Then, the back-up housing 45 of upper back-up rolls 60*a*, 60*b* is unlocked or unclamped vertically from clamps 30, 32 from its working position. Vertical hydraulic cylinders 46, 48 then lower the back-up housing until the teeth 21 on the back-up housing clear the teeth 27 on the leveler housing or frame. Alternatively, screw-jacks could be used. At that time, the back-up housing can be shifted horizontally by a hydraulic mechanism 50. This horizontal shift of the back-up housing accomplishes two things: 1) It places the mating teeth of the back-up housing and the leveler housing directly in line with each other, where the teeth 27 of the housing are directly above the teeth 21 of the back-up housing; and, 2) It shifts the back-up rolls 60*a*, 60*b* by approximately one-half pitch.

At this time, the vertical cylinders 46, 48 retract to bring the teeth on the back-up housing tight against the teeth on the leveler upper housing (shown in FIG. 3), and then the back-up housing is clamped to the leveler frame via clamps 30, 32. Then, the smaller diameter work roll cassette 42 is then injected or installed into the leveler and drive shafts 52 (shown in FIG. 2) are engaged.

Figure 3:
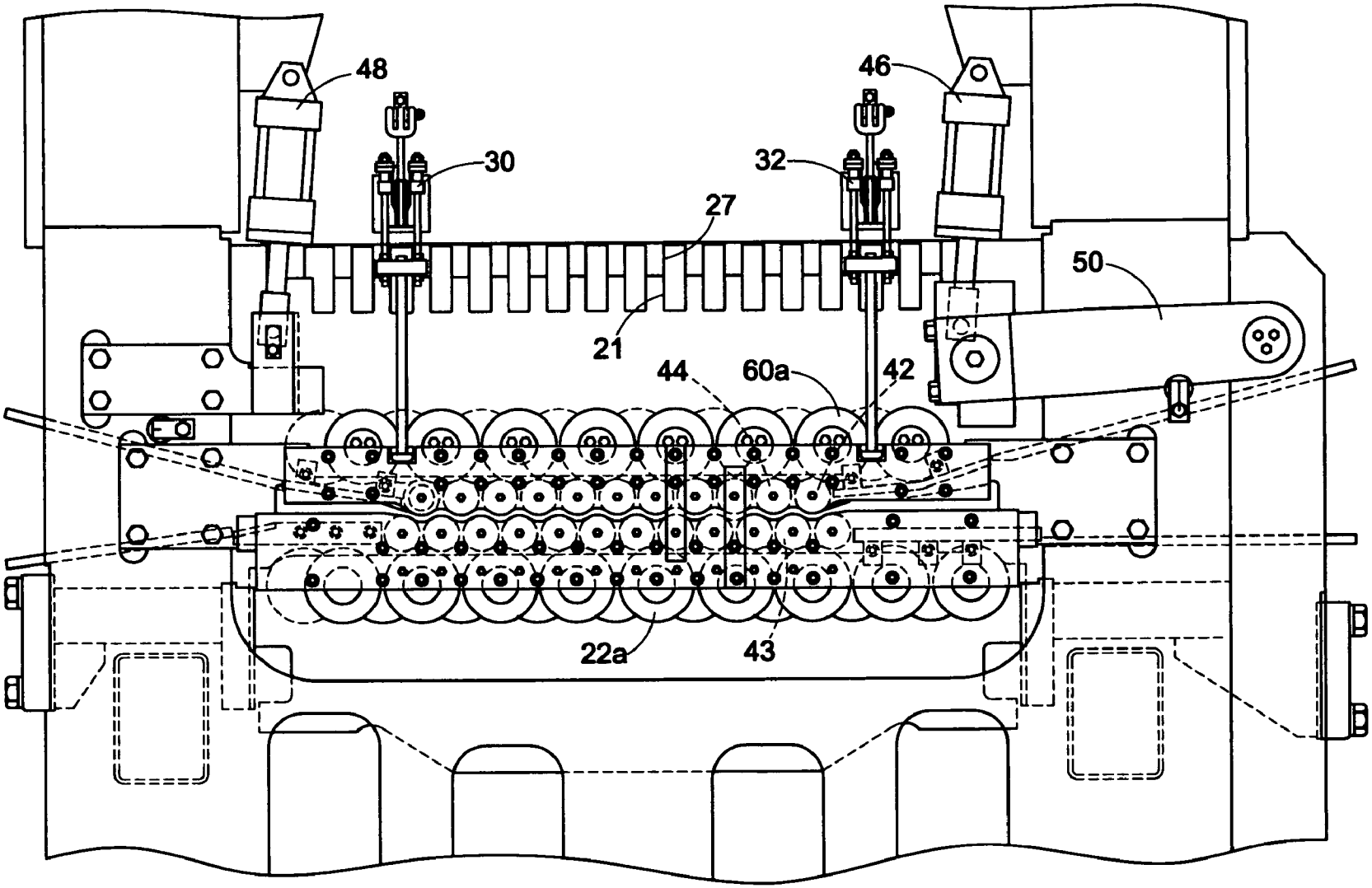
FIG. 3 is a side elevational view of a roller leveler illustrating small diameter work rolls and common back-up rolls in accordance with another aspect of the present invention.

The new position of the back-up housing, as shown in FIG. 3, is now properly positioned for both vertically and horizontally supporting the smaller diameter work rolls 44, 43.

To remove the smaller diameter work roll cassette 42 from the leveler, the smaller diameter work roll cassette 42 is removed or ejected. Then, the back-up housing 45 of upper back-up rolls 60*a*, 60*b* is unlocked or unclamped vertically from clamps 30, 32 from its working position. Vertical hydraulic cylinders 46, 48 then lower the back-up housing until the teeth 21 on the back-up housing clear the teeth 27 on the leveler housing or frame. At that time, the back-up housing can be shifted horizontally by a hydraulic mechanism 50 so the back-up rolls 60*a*, 60*b* shift by approximately one-half pitch and so the teeth 21 of the back-up housing can nest within the teeth 27 of the leveler frame.

At this time, the vertical cylinders 46, 48 retract to bring the teeth 21 on the back-up housing to nest within the teeth 27 on the leveler upper housing, and then the back-up housing is locked or clamped to the leveler frame via clamps 30, 32. The larger diameter work roll cassette 40 is then injected or installed into the leveler and drive shafts 52 are engaged.

The new position of the back-up housing, as shown in FIG. 1, is now properly positioned for both vertically and horizontally supporting the larger diameter work rolls 20, 36.

Referring now to FIG. 2, upper work rollers 20 and lower work rollers 36 are individually driven by drive shafts 52. There are lower back-up roller mounting beams 54 evenly spaced along the span of the lower work rollers 36, each mounting beam carrying a flight of lower back-up rollers 22*a*, 22*b* extending from front to rear of the roller leveler. The back-up rollers are spaced so that each flight provides two back-up rolls in tangential contact with each lower work roll. The back-up rollers are not in line across the width of the support beam. They are staggered, so only two back-up rollers are in tangential contact with the work roll. Except for the outboard, back-up rolls, forward and rearward of each flight, the intermediate back-up rolls are each in shared tangential supporting contact with a pair of work rolls 36. In one embodiment, there can be a total of nine lower work rolls and eighteen lower back-up rolls per flight, and eight upper work rolls and sixteen upper back-up rolls per flight.

Referring to FIG. 2, a hydraulic cylinder 56 is mounted under the front end of each lower back-up roll mounting beam 54, and a second hydraulic cylinder 58 is mounted under a rearward end of each lower back-up roll mounting beam. Actuation of hydraulic cylinders 56, 58 will cause lower back-up roll mounting beam 54 to shift vertically and/or arcuately to bring lower back-up rolls 22*a*, 22*b* into tangential pressure contact with adjacent lower work rollers 36.

Similarly, as shown in FIG. 2, there are also flights of upper back-up roll mounting beams 26 evenly spaced along the span of upper work rollers 20. Each mounting beam 26 carries a flight of upper back-up rolls 60*a*, 60*b* arranged front and rear of rollers 20 for tangential contact therewith. The flights of upper back-up rolls 60*a*, 60*b* are aligned from front to rear of the roller leveler. A flight of upper back-up rolls 60*a*, 60*b* are mounted on each back-up roll mounting beam 26. The upper back-up rolls are also positioned so that each flight provides two back-up rolls in tangential contact with each upper work roller in the same manner as described with respect to lower back-up rolls 22*a*, 22*b*.

Cylinders 46, 48 along with rotary actuator 50 (FIG. 1), are used to shift the upper back-up rollers vertically and/or horizontally such that the teeth shown on the back-up housing are either nested as shown in FIG. 1 to accommodate larger diameter work rolls or extended vertically and shifted laterally and lowered to accommodate small diameter work rolls. Thus, the same or common back-up rolls can be used, even though the smaller diameter work rolls can be replaced with larger diameter work rolls.

The exemplary embodiment has been described with reference to the preferred embodiment. Obviously, modifications and alterations will occur to others upon reading and understanding the preceding detailed description. It is intended that the exemplary embodiment be construed as including all such modifications and alterations.

The invention claimed is:

1. A roller leveler, comprising:

a frame;

a first bank of upper and lower work rolls journalled in said frame via a work roll journal housing;

a bank of back-up rolls in contact with said work rolls to support said work rolls;

said work rolls perform leveling on a work product passing through a gap formed between upper and lower work rolls;

said bank of back-up rolls mounted to said roller leveler frame via a back-up housing;

wherein said first bank of upper and lower work rolls are removed and a second bank of upper and lower work rolls are installed wherein said second bank of upper and lower work rolls have a different diameter than said first bank of upper and lower work rolls;

a positioning member for locking said back-up housing into position for allowing installation of said first bank or said second bank of upper and lower work rolls;

wherein said positioning member comprises a set of teeth on said back-up housing which nest with teeth on said frame when said first bank of upper and lower work rolls are installed;

wherein said back-up housing is lowered via hydraulic cylinders mounted to opposite sides of said back-up housing until said teeth of said back-up housing clear said teeth of said leveler frame wherein said teeth of said frame are directly above said teeth of said back-up housing.

2. The roller leveler of claim 1, wherein said second bank of upper and lower work rolls have a smaller diameter than said first bank of upper and lower work rolls.

3. The roller leveler of claim 1, wherein said back-up housing is shifted horizontally by a hydraulic mechanism attached to said back-up housing.

4. The roller leveler of claim 3, wherein said back-up housing is raised via said hydraulic cylinders until said teeth of said back-up housing are nested within teeth of said leveler frame.

5. The roller leveler of claim 4, wherein said first bank of upper and lower work rolls is inserted adjacent said bank of said back-up rolls.

6. The roller leveler of claim 1, wherein said back-up housing is clamped onto said frame via clamps such that said teeth of said back-up housing abut said teeth of said leveler frame.

7. The roller leveler of claim 6, wherein said second bank of upper and lower work rolls is inserted adjacent said bank of said back-up rolls.

8. A method of installing various diameter work rolls in a roller leveler, comprising:

removing a first work roll cassette comprising upper and lower work rolls of a first diameter;

unlocking a back-up roll housing from a leveler frame;

lowering said back-up housing until said back-up housing clears said leveler frame;

shifting said back-up roll housing horizontally to shift back-up rolls by approximately a half pitch;

raising said back-up housing until said back-up housing contacts said leveler frame;

locking said back-up housing to said leveler frame; and installing a second work roll cassette comprising upper and lower work rolls of a second diameter into said leveler, wherein said second diameter is a different diameter than said first diameter;

wherein said lowering step comprises lowering of said back-up housing until teeth on said back-up housing clear teeth on said leveler frame.

9. The method of claim 8, wherein said step of lowering said back-up housing comprises lowering said back-up housing via a pair of hydraulic cylinders.

10. The method of claim 8, wherein said step of shifting said back-up housing horizontally comprises shifting of the back-up housing via a hydraulic mechanism.

11. The method of claim 8, wherein said unlocking step comprises unclamping clamps which clamp said back-up roll housing on said leveler frame.

12. The method of claim 8, wherein said raising step comprises raising said back-up housing until said teeth of said back-up housing are below and abut said teeth of said leveler frame.

13. The method of claim 8, where said locking step comprises clamping said back-up housing to said leveler frame via clamps.

14. The method of claim 8, wherein said second diameter of said second work roll cassette is a smaller diameter than said first diameter of said first work roll cassette.

15. A method of installing work rolls in a roller leveler, comprising:

removing a work roll cassette of work rolls of a first diameter;

unlocking a back-up roll housing from a leveler frame;

shifting said back-up housing horizontally to shift back-up rolls by approximately a half pitch;

raising said back-up housing until said back-up housing is in contact with said leveler frame;

locking said back-up roll housing to said leveler frame; and installing a work roll cassette of work rolls of second diameter, wherein said second diameter is larger than said first diameter;

wherein said raising step comprises raising said back-up housing until teeth of said back-up housing are nested within teeth of said leveler frame.

16. The method of claim 15, wherein said step of raising said back-up housing comprises raising said back-up housing via a pair of hydraulic cylinders.

17. The method of claim 15, wherein said step of shifting said back-up housing horizontally comprises shifting of the back-up housing via a hydraulic mechanism.

18. The method of claim 15, wherein said unlocking step comprises unclamping clamps which clamp said back-up roll housing on said leveler frame.

19. The method of claim 15, where said locking step comprises clamping said back-up housing to said leveler frame via clamps.

* * * * *